US007695383B2

(12) United States Patent
Severa et al.

(10) Patent No.: US 7,695,383 B2
(45) Date of Patent: Apr. 13, 2010

(54) RACQUET STRINGING MACHINE

(75) Inventors: William D. Severa, Darien, IL (US); Ronald R. Rocchi, Naperville, IL (US); John B. Lyons, Wilmette, IL (US); Robert T. Kapheim, Elmhurst, IL (US); Daniel R. Nett, Sun Prairie, WI (US); Craig P. Conner, Madison, WI (US); Erik B. van der Pols, Taichung Hsien (TW)

(73) Assignees: Wilson Sporting Goods Co., Chicago, IL (US); Elding Ind. Co., Ltd., Taichung Hsien (TW)

( * ) Notice: Subject to any disclaimer, the term of this patent is extended or adjusted under 35 U.S.C. 154(b) by 207 days.

(21) Appl. No.: 12/077,012

(22) Filed: Mar. 14, 2008

(65) Prior Publication Data

US 2008/0254924 A1 Oct. 16, 2008

Related U.S. Application Data

(60) Provisional application No. 60/922,799, filed on Apr. 11, 2007.

(51) Int. Cl.
*A63B 51/14* (2006.01)

(52) U.S. Cl. ..... 473/557

(58) Field of Classification Search ..... 473/555–557
See application file for complete search history.

(56) References Cited

U.S. PATENT DOCUMENTS

| | | | | |
|---|---|---|---|---|
| 2,015,238 | A | 9/1935 | Saladino | 273/73 |
| 2,043,813 | A | 6/1936 | Saladino | 273/73 |
| 2,100,948 | A | 11/1937 | Doll | 273/73 |
| 4,546,977 | A | 10/1985 | Bosworth, Jr. et al. | |
| 4,620,705 | A | 11/1986 | Tsuchida | |
| 4,706,955 | A | 11/1987 | Ngadi et al. | |
| 5,026,055 | A | 6/1991 | Longeat | |
| 5,080,360 | A | 1/1992 | Longeat | |
| 5,090,697 | A | 2/1992 | Lee | |
| 5,186,505 | A | 2/1993 | Chu | |
| 5,269,515 | A | 12/1993 | Chu | |
| 5,338,028 | A | 8/1994 | Sung | |
| 5,568,921 | A | 10/1996 | Lorentzen et al. | |
| 5,590,877 | A | 1/1997 | Ho | |

(Continued)

FOREIGN PATENT DOCUMENTS

| | | | |
|---|---|---|---|
| DE | 29 15 647 | A1 | 10/1980 |

(Continued)

OTHER PUBLICATIONS

Owner's manual for Wilson EX-7900W Digital Stringing Machine.
Web pages illustrating Alpha Stringway Stringing Machines.

*Primary Examiner*—Raleigh W. Chiu
(74) *Attorney, Agent, or Firm*—Terence P. O'Brien; Melanie Rauch

(57) ABSTRACT

An ergonomically-designed racquet stringing machine. In certain embodiments, the stringing machine includes a stand extending from a base at an angle between about 70 and about 89 degrees from horizontal. In certain embodiments, the stringing machine includes a releasable resistance assembly configured to provide resistance to rotation of the turntable about an axis.

22 Claims, 11 Drawing Sheets

U.S. PATENT DOCUMENTS

| | | | | |
|---|---|---|---|---|
| 5,639,086 | A | 6/1997 | Wolverton et al. | |
| 5,733,212 | A | 3/1998 | Wise et al. | |
| 5,820,500 | A | 10/1998 | Raos | |
| 5,908,362 | A | 6/1999 | Carr | |
| 6,162,139 | A | 12/2000 | Bassili | |
| 6,227,990 | B1 | 5/2001 | Wise et al. | |
| 6,398,674 | B2 | 6/2002 | Tsuchida | |
| 6,583,590 | B1 * | 6/2003 | Chu | 318/34 |
| 6,712,723 | B2 | 3/2004 | You | |
| 6,764,418 | B1 | 7/2004 | Lee | |
| 6,837,811 | B1 | 1/2005 | Wu | |
| 7,153,226 | B1 * | 12/2006 | Van Der Pols | 473/557 |
| 7,192,370 | B2 * | 3/2007 | van der Pols | 473/557 |
| 7,448,970 | B2 * | 11/2008 | Li | 473/557 |
| 7,455,604 | B2 * | 11/2008 | Li | 473/557 |
| 7,468,011 | B2 * | 12/2008 | Tsuchida | 473/557 |
| 2003/0022740 | A1 | 1/2003 | You | |
| 2003/0027670 | A1 * | 2/2003 | van der Pols | 473/557 |
| 2005/0096160 | A1 | 5/2005 | Nakane et al. | |
| 2008/0167147 | A1 * | 7/2008 | Li | 473/557 |
| 2008/0214337 | A1 * | 9/2008 | Tsuchida | 473/555 |
| 2008/0242454 | A1 * | 10/2008 | Li | 473/556 |
| 2008/0254922 | A1 * | 10/2008 | Severa et al. | 473/556 |
| 2008/0254923 | A1 * | 10/2008 | Severa et al. | 473/557 |
| 2008/0254924 | A1 * | 10/2008 | Severa et al. | 473/557 |

FOREIGN PATENT DOCUMENTS

| | | | | |
|---|---|---|---|---|
| EP | 0136245 | A2 | | 4/1985 |
| EP | 136245 | A2 | * | 4/1985 |
| JP | 2008178435 | A | * | 8/2008 |
| JP | 2008302209 | A | * | 12/2008 |
| JP | 2008302210 | A | * | 12/2008 |
| JP | 2009006121 | A | * | 1/2009 |
| WO | WO 95/29740 | | | 11/1995 |

* cited by examiner

RACQUET STRINGING MACHINE

RELATED U.S. APPLICATION DATA

Provisional Application Ser. No. 60/922,799 filed on Apr. 11, 2007

FIELD OF THE INVENTION

The present invention relates to a machine for stringing racquets. This stringing machine has enhanced ergonomic features.

BACKGROUND OF THE INVENTION

The act of stringing a racquet requires a considerable amount of manual labor. Stringing machines assist in the process by maintaining the racquet in place and providing desired tension in the strings, but a majority of the work involved is performed by a person. More particularly, a person must align the racquet within the stringing machine, and then string each of the cross or main strings individually, followed by weaving each of the cross and main strings to form the resulting string grid.

Those in the racquet stringing business often spend many hours a day standing in front of a stringing machine. Conventional stringing machines include a stringing platform with a turntable positioned on top of a fixed stand. The turntable spins within a plane parallel to the floor. Because of the fixed orientation of the stand and the planar position of the turntable, the person stringing the racquet must adjust his or her posture to conform to the position of the stringing machine. In particular, one of the racquet stringer's shoulders is often positioned much higher than the other. Also, the fixed orientation of the stringing machine often induces the racquet stringer to hunch over the turntable. The awkward posture induced by conventional stringing machines often causes injuries and fatigue, which ultimately lead to reduced efficiency in the performance of the racquet stringer. Additionally, conventional stringing machines typically include a vertical stand on a base. The stand and/or base can interfere with the placement of the stringer's feet and/or legs, leading to additional awkwardness in the stringer's posture.

During the stringing process, the racquet is clamped to the stringing platform and the turntable allows the racquet stringer to manually spin the racquet to adjust the positioning of the racquet with respect to the various steps of the stringing process. Turntables on conventional stringing machines are generally free to spin in response to any applied tangential force unless or until a brake is applied, with the brake preventing any further spinning. If the stringing platform were positioned in the stringing machine such that the turntable spins in a plane non-parallel with the floor, namely tilted toward the racquet stringer, the handle of any racquet clamped to the stringing platform would be drawn by gravity to the lowest point within the plane. Consequently, even though the positioning of the turntable may be more comfortable for the user, the need to either continually move the racquet back into its intended position or continually lock and unlock the brake on the turntable in order to overcome the effects of gravity on the clamped-on racquet would be a nuisance.

It would thus be desirable to provide a stringing machine that is ergonomically designed to allow users to work with the stringing machine without having to assume awkward or uncomfortable positions, and without having to continuously manually override effects of gravity on the turntable.

SUMMARY OF THE INVENTION

The present invention presents an ergonomically-designed racquet stringing machine for stringing of a racquet by a user. The stringing machine includes a base configured for supporting the stringing machine on a generally horizontal surface, a stand having upper and lower end regions, the lower end region of the stand upwardly extending from a first location of the base, an adjustable stringing platform coupled at a second location to the upper end region of the stand, and a string tensioning assembly coupled to the stand.

The "first location" of the base may be defined as the center of the footprint resulting from the attachment of the stand to the base. Similarly, the "second location" may be defined as the center of the footprint resulting from the attachment of the stringing platform to the stand. The "footprint" is a two-dimensional representation of the intersection of two parts that depicts the area of that intersection. The first and second locations define a line that is angled by a predetermined angle from horizontal.

In one embodiment, the stand extends from the base at an angle between about 70 and about 89 degrees from a horizontal plane (1 and 20 degrees from a vertical plane). Alternatively, the angle between the stand and the base may be between about 80 and about 85 degrees from a horizontal plane (5 and 10 degrees from a vertical plane), for example 83 degrees from a horizontal plane (7 degrees from a vertical plane). This angled orientation of the stand provides ample legroom for the user standing in front of the stringing machine. Additionally, a forward side of the base intended to face the user may define a recessed area for accommodating at least a portion of the user's feet thereby enabling the user to stand closer to the racquet during stringing.

The angle between the base and the stand may be adjustable. For instance, a stand adjustment assembly capable of adjusting the angle of the line defined by the first and second locations may be coupled to the base and the stand. The stand adjustment assembly may be configured to adjust the angle of the line within a range of 0.1 to 15.0 degrees.

In another embodiment, the adjustable stringing platform may include a turntable rotatable about a first axis, and a first releasable resistance assembly, such as a grease brake, coupled to the turntable. The first releasable resistance assembly may be positionable between an engaged operating position in which the resistance assembly resists rotation of the turntable about the first axis, and a disengaged operating position in which the resistance assembly does not resist rotation of the turntable about the first axis.

The first releasable resistance assembly can provide resistance to unintentional rotation of the turntable. In particular, the first releasable resistance assembly can negate the effects of gravity when a racquet is in place and the stringing platform is tilted, such as may be caused by the tilted angle of the stand. For example, the first releasable resistance assembly may provide a resistance against rotation of the turntable (resistance against a torque) about the first axis of within the range of 0.1 to 36 in-lbf, or more preferably within the range of 0.1 to 12.0 in-lbf.

The first releasable resistance assembly suitably includes a high viscosity fluid, such as a grease, for resisting rotation of the turntable when in the engaged operating position. The high viscosity fluid may have a viscosity range of 1 to 500 centipoise (cP), for example. In certain embodiments, the first releasable resistance assembly includes first and second members contacting the high viscosity fluid, with at least one of the first and second members being rotatable about the first axis. The first and/or second members may include a plurality of projections, such as spaced-apart concentric rings, contacting the fluid. For example, each of the first and second members may include a plurality of spaced-apart concentric rings with the rings of the first and second portions configured to correspond to each other such that portions of the rings of one of the members fit within the spaces between the rings of the other member. The first releasable resistance assembly may also include a latch that releasably engages the first member to prevent the first member from rotating about the first axis.

A second releasable resistance assembly, separate from the first releasable resistance assembly, may also be coupled to the stringing platform. For example, the turntable may include a ring centered about the first axis, and the second releasable resistance assembly may be configured to releasably engage the ring to prevent rotation of the turntable about the first axis.

Any one or more of the stringing machine embodiments described herein may be applied to machines for stringing tennis racquets, racquetball racquets, squash racquets, badminton racquets, and any other strung racquet. Regardless of the type of racquet, compatibility of the stringing machine with the user is greatly improved by using any of the stringing machine enhancements in this invention.

DETAILED DESCRIPTION OF THE INVENTION

Figure 1:
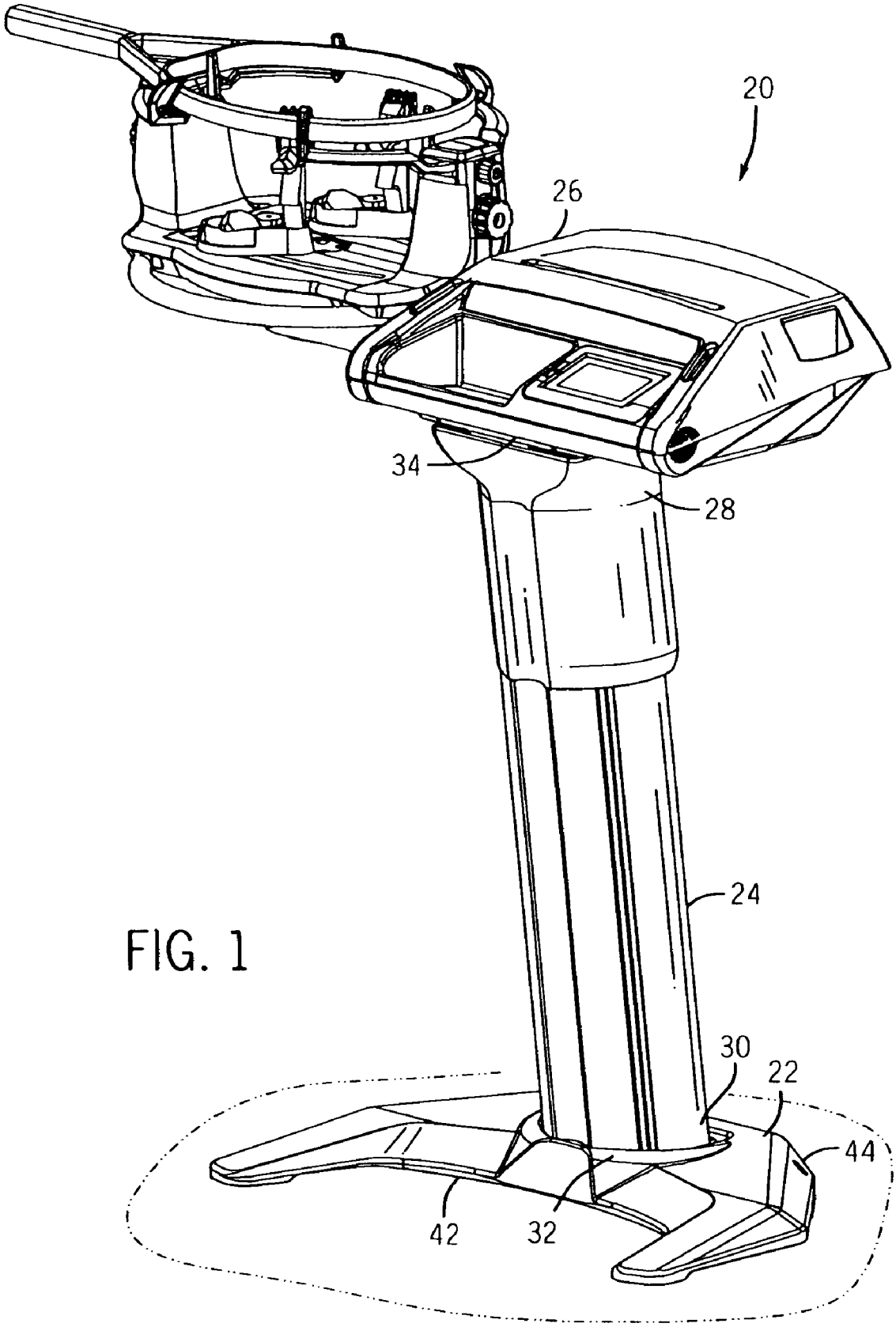
FIG. 1 is a perspective view of a racquet stringing machine.
Figure 2:
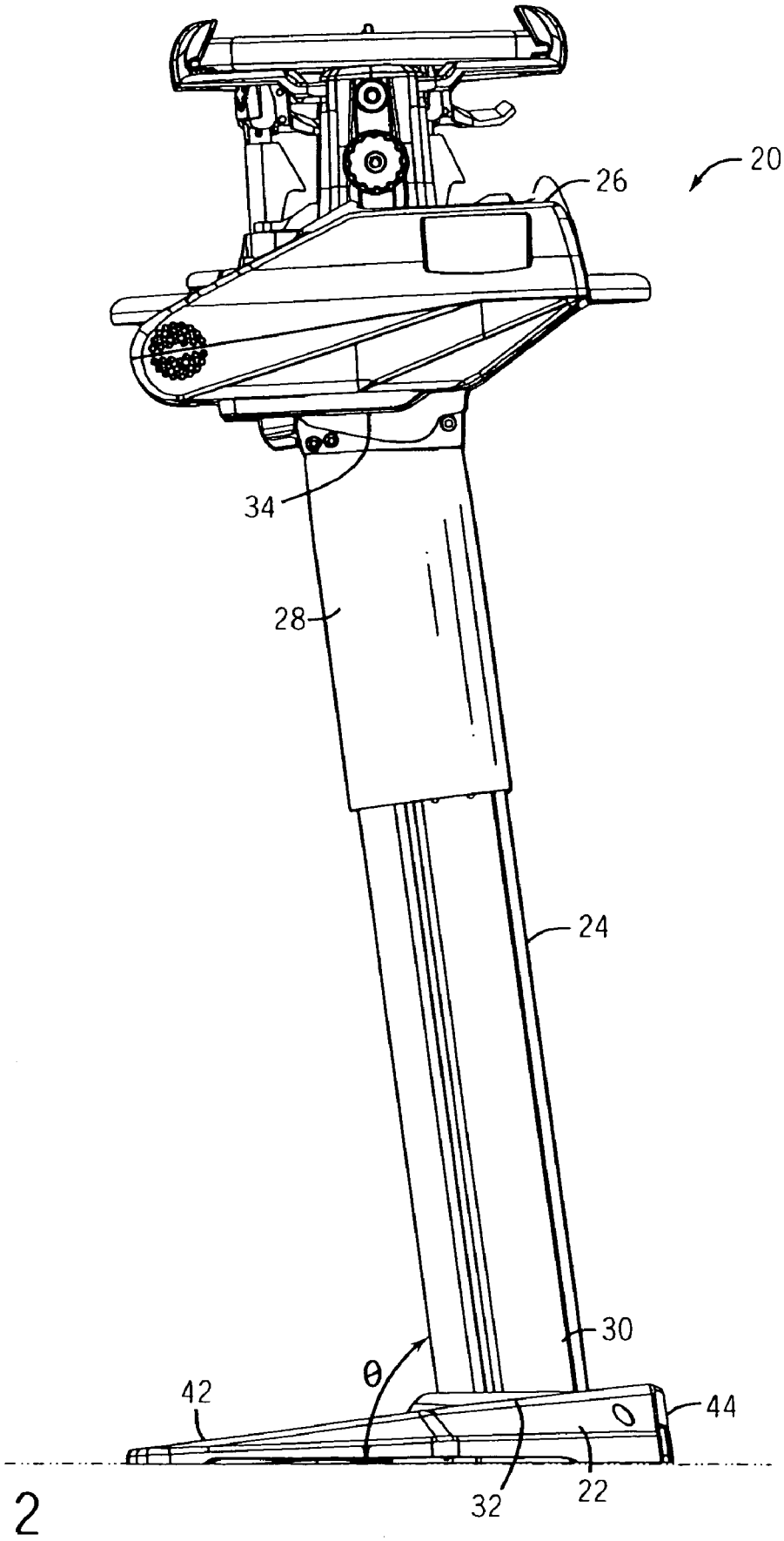
FIG. 2 is a side view of a racquet stringing machine.

Referring to FIGS. 1 and 2, an ergonomically-designed racquet stringing machine is indicated generally at 20. The ergonomic features of the stringing machine 20 are intended to provide enhanced comfort for a user during the process of stringing a racquet.

Figure 3:
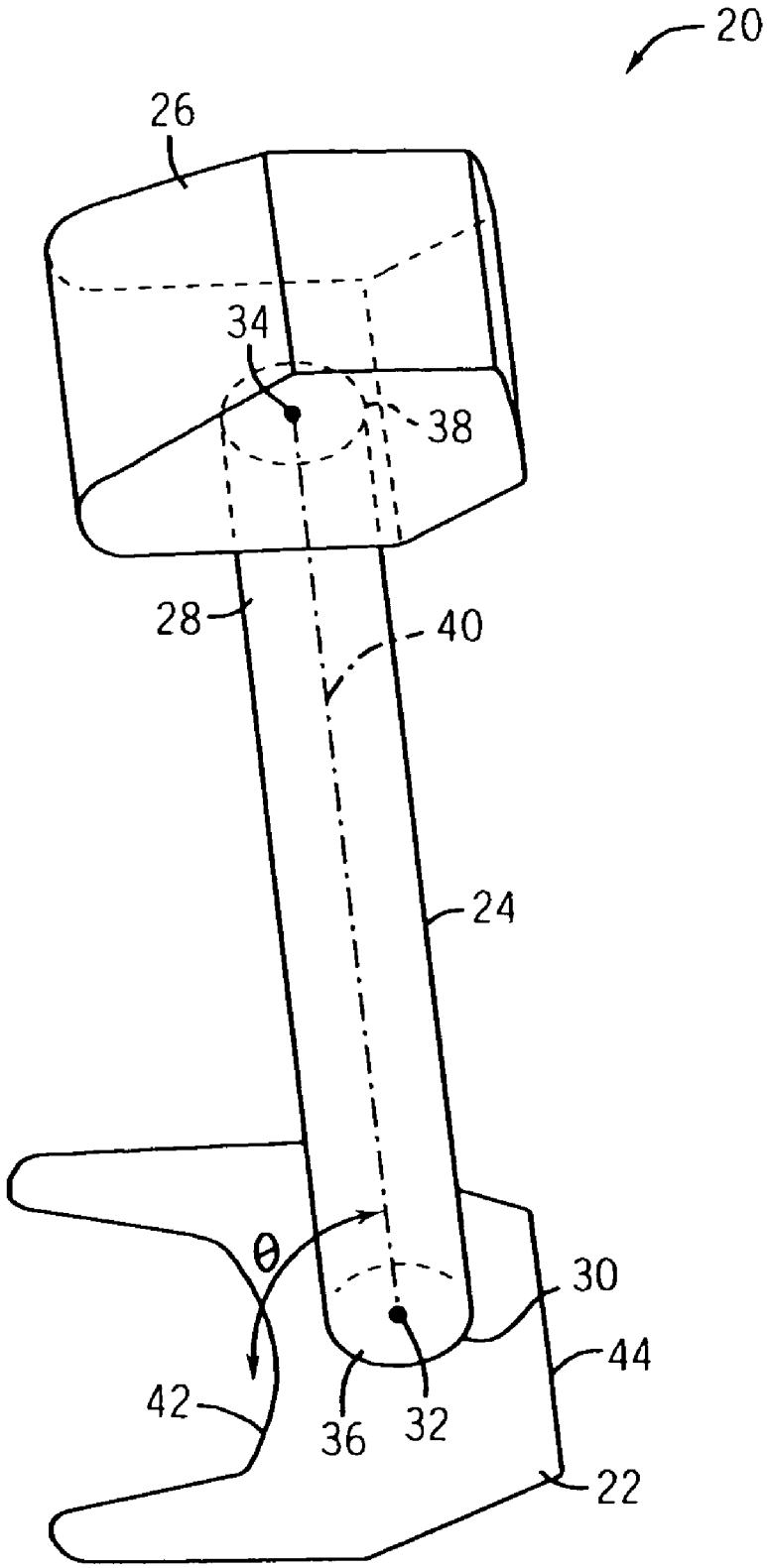
FIG. 3 is a schematic view of a racquet stringing machine.

The stringing machine 20 includes a base 22 configured for supporting the stringing machine 20 on a generally horizontal surface, and a stand 24 having an upper end region 28 and a lower end region 30. The lower end region 30 of the stand 24 extends upwardly from a first location 32 on the base 22, and an adjustable stringing platform 26 is coupled to the upper end region 28 of the stand 24 at a second location 34 on the stringing platform 26, as shown in FIG. 3.

The "first location" 32 on the base 22 may be defined as the center of the footprint 36 resulting from the attachment of the stand 24 to the base 22. Similarly, the "second location" 34 may be defined as the center of the footprint 38 resulting from the attachment of the stringing platform 26 to the stand 24. The "footprint" is a two-dimensional representation of the intersection of two parts that depicts the area of that intersection. The first and second locations 32, 34 define a line 40 that is angled by a predetermined angle (θ) from horizontal. It is this line 40 to which we refer when discussing the angle θ between the stand 24 and the base 22. The stand 24 itself may be curved, such as a "C" shape, or may appear to be bent at one or more locations along its length, but in any case, if the line 40 connecting the first location 32 and the second location 34 defines an angle θ from horizontal within the range defined herein, the stringing machine 20 is still considered to fall within the scope of this invention.

In certain embodiments, the stand 24 extends from the base 22 at an angle θ between about 70 and about 89 degrees from a horizontal plane (1 and 20 degrees from a vertical plane), in a direction generally toward the user. Alternatively, the angle θ between the stand 24 and the base 22 may be between about 80 and about 85 degrees from a horizontal plane (5 and 10 degrees from a vertical plane), for example 83 degrees from a horizontal plane (7 degrees from a vertical plane). In contrast, conventional stringing machines are configured with a stand that extends perpendicularly from a base. The angled orientation of the stand 24 described in the present invention provides ample legroom for the user standing in front of the stringing machine 20. More particularly, by tilting the stand 24 at an angle θ non-perpendicular to the base 22, more legroom can be created for the user, thereby allowing the user to stand closer to the stringing machine 20. For example, a 7-degree tilt, such that the angle θ is 83 degrees from a horizontal plane, provides 40-50% more legroom compared to a stand 24 that is perpendicular to the base 22.

Additionally, the base 22 may be configured to provide a comfortable standing area for the user. The base 22 includes a forward side 42 intended to face the user and a rear side 44 opposite the forward side 42. As illustrated in FIGS. 1-3, the forward side 42 of the base 22 may define a recessed area for accommodating at least a portion of the user's feet, thereby enabling the user to stand closer to the racquet during the stringing process.

Figure 5:
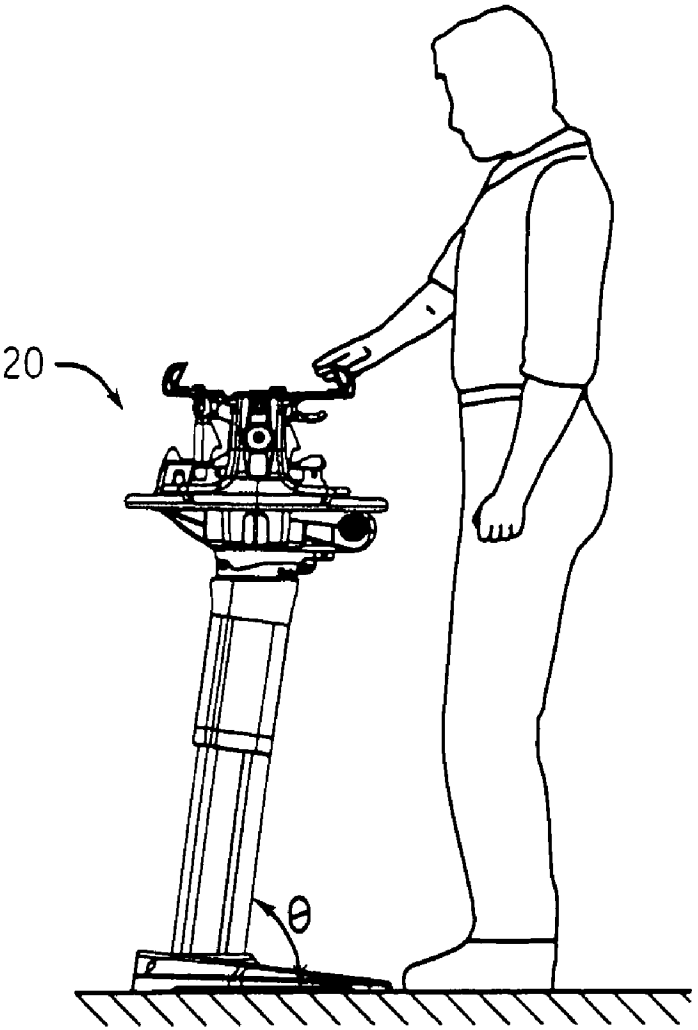
FIG. 5 is a side view of a user in a preferred posture while clamping a racquet on a racquet stringing machine.
Figure 4:
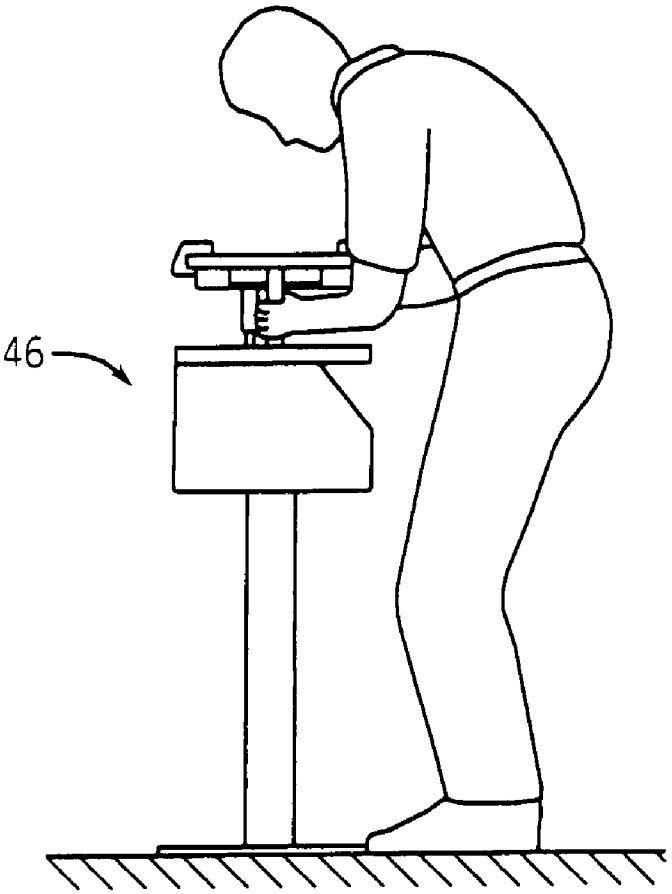
FIG. 4 is a side view of a user in an induced posture while clamping a racquet on a racquet stringing machine.

When stringing a racquet, the racquet must first be clamped onto the adjustable stringing platform 26. As illustrated in FIG. 4, conventional stringing machines 46 induce poor posture for many users trying to clamp the racquet onto the stringing platform. By configuring the stand 24 to extend at a non-perpendicular angle θ between the base 22 and the stand 24 and increasing the height of the stand 24, the user in the desired operating position can stand closer to the stringing platform 26, thereby preventing the user from hunching over the stringing platform 26, as shown in FIG. 5. The height of the stand 24 may either be fixed or adjustable. Any suitable height-adjusting mechanism can be applied to the stringing machine 20, such as a telescoping height-adjustment mechanism.

Figure 7:
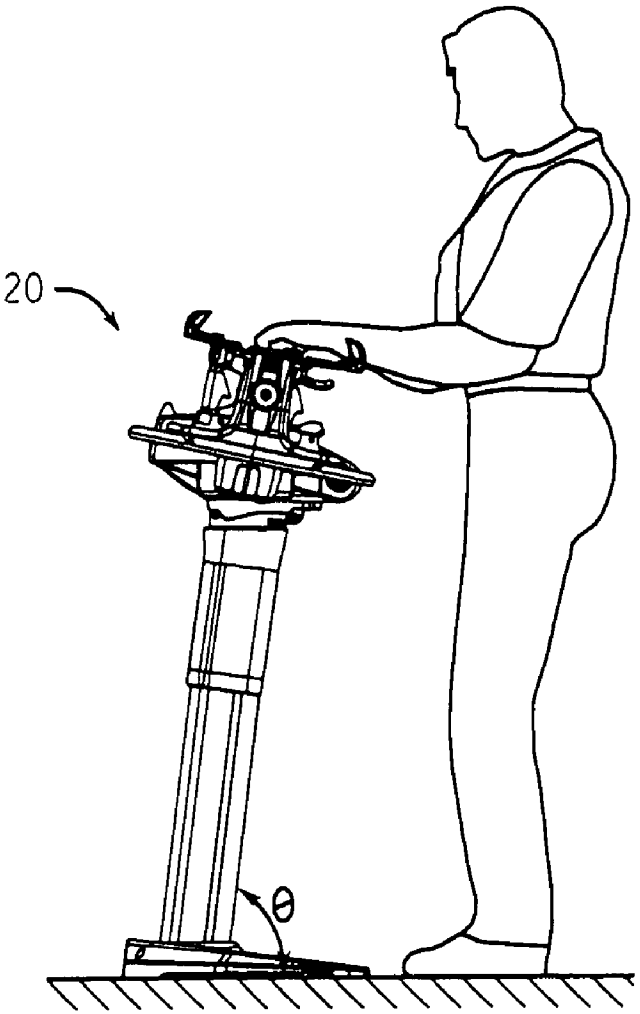
FIG. 7 is a side view of a user in a preferred posture while stringing main strings on a racquet.
Figure 6:
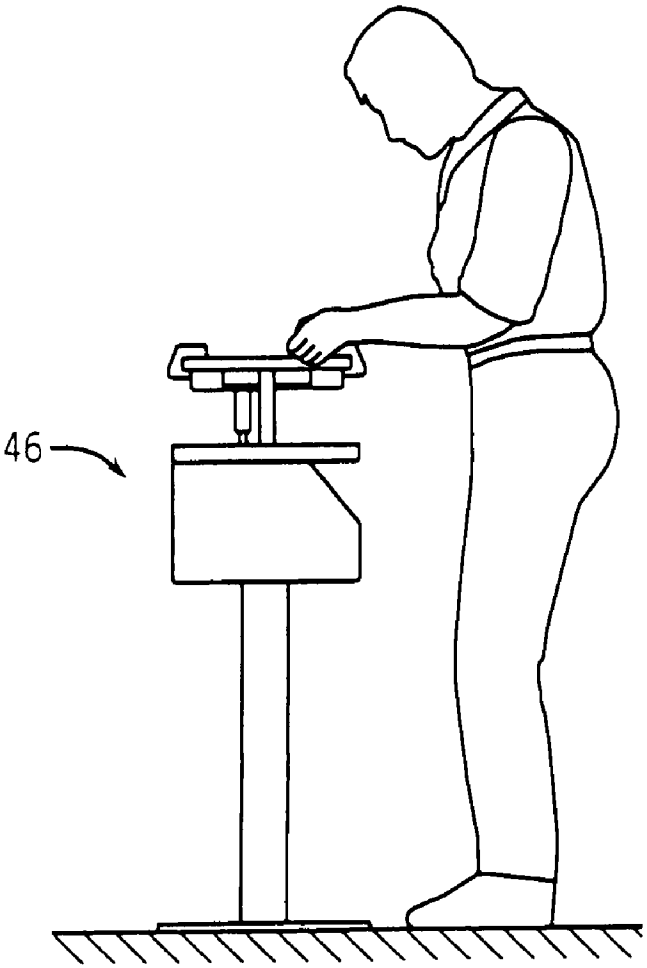
FIG. 6 is a side view of a user in an induced posture while stringing main strings on a racquet.

Additional steps in the stringing process also induce poor posture for many users. As shown in FIG. 6, the process of stringing the main strings may cause neck strain or other discomfort due to the positioning of the stringing platform with respect to the user's position. Once again, by configuring the stand 24 to extend at a non-perpendicular angle θ between the base 22 and the stand 24 and increasing the height of the stand 24, the positioning of the stringing platform 26 suitably provides a comfortable working area for the user in which the user, in the desired operating position, is able to stand upright in a relatively comfortable position, as shown in FIG. 7.

Figure 9:
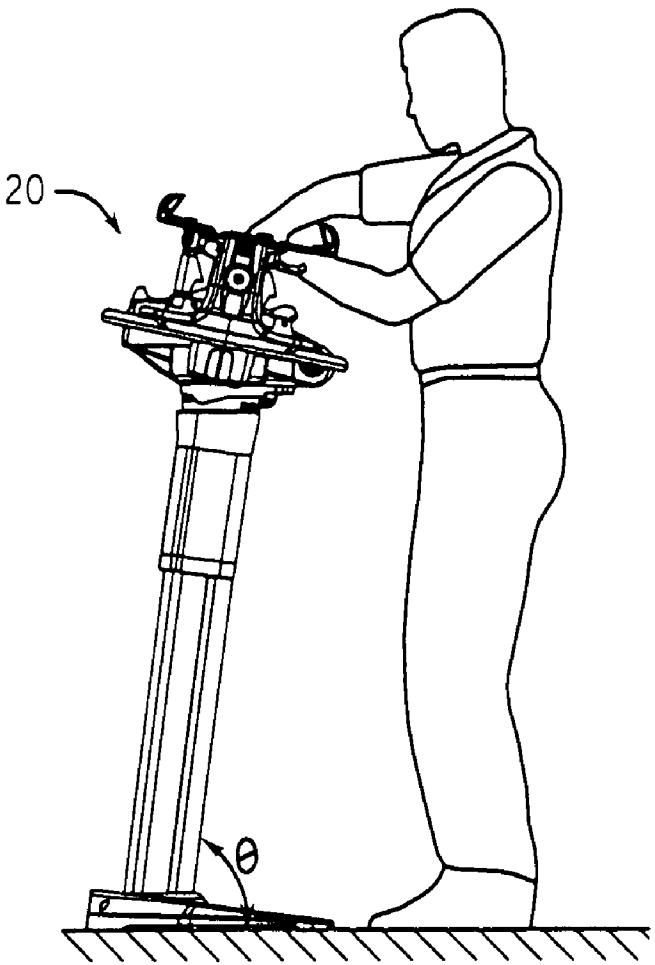
FIG. 9 is a side view of a user in a preferred posture while weaving cross strings on a racquet.
Figure 8:
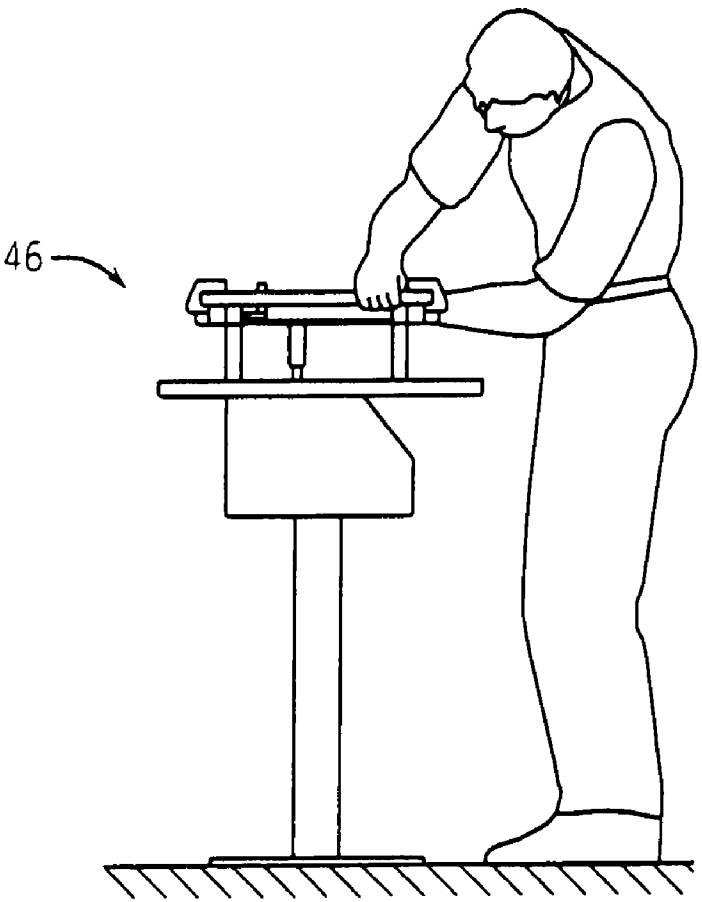
FIG. 8 is a side view of a user in an induced posture while weaving cross strings on a racquet.

Similarly, the detail-oriented process of weaving cross strings may also cause neck strain or other discomfort, as exemplified in FIG. 8. By configuring the stand 24 to extend at a non-perpendicular angle θ between the base 22 and the stand 24, the height and angle of the stringing platform 26 can be arranged in a position that allows the user to weave the cross strings in a more ergonomically preferable operating position, as shown in FIG. 9.

Figure 10:
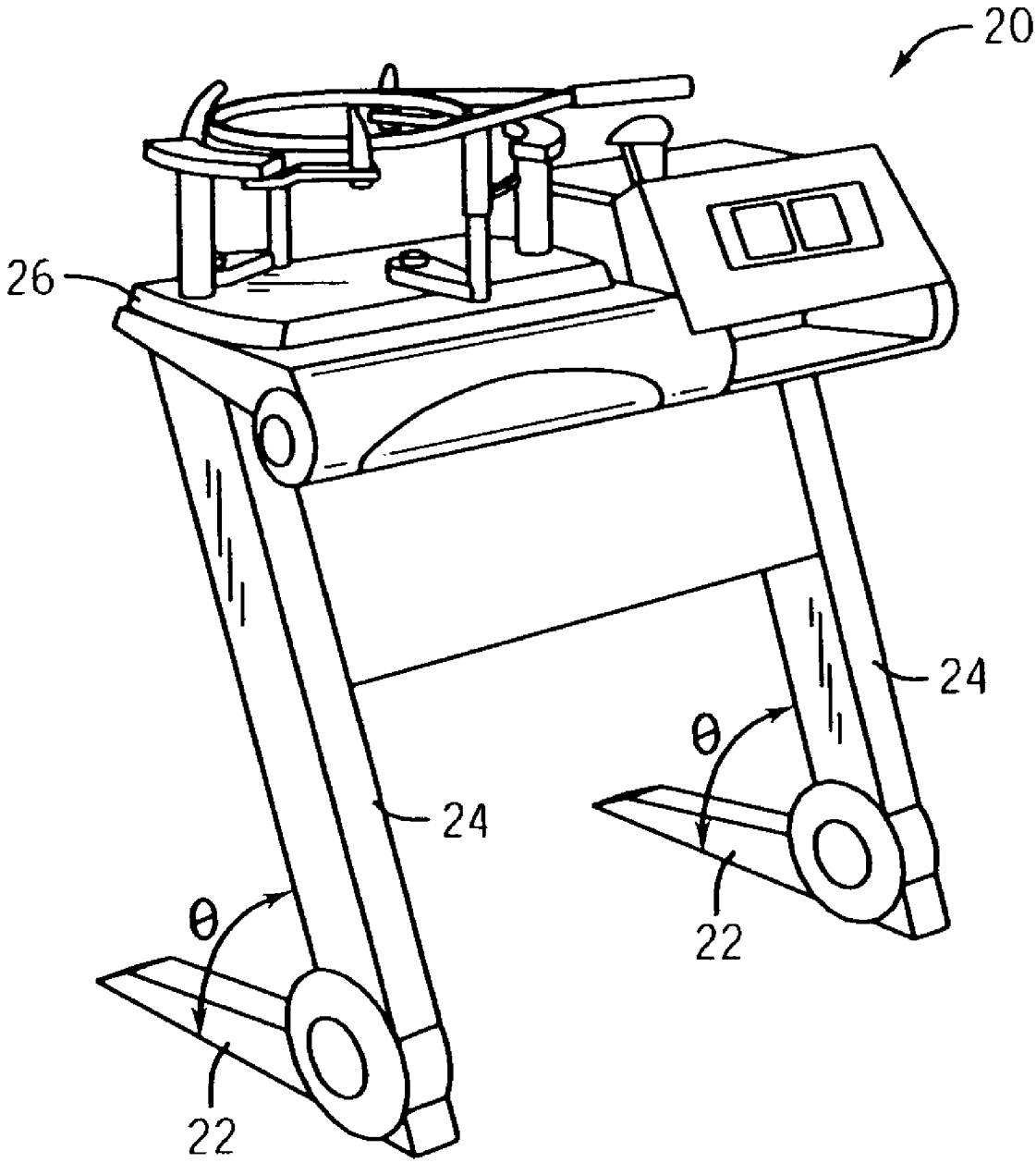
FIG. 10 is another perspective view of a racquet stringing machine.

The base 22 and stand 24 may be a single-leg design, as illustrated in FIGS. 1 and 2. Alternatively, a two-leg design, as illustrated in FIG. 10, may work equally well. In any case, the base 22 may be die-cast for added stability. The major components of the stringing machine 20, namely the base 22, stand 24, and stringing platform 26, may be formed of metal, wood, plastic, high-strength polymers, composite materials, or any combination of these materials, for example.

In certain embodiments, the angle θ between the base 22 and the stand 24 may be permanently fixed, or non-adjustable. In other embodiments, however, the angle θ between the base 22 and the stand 24 may be adjustable. For instance, a stand adjustment assembly capable of adjusting the angle θ of the line 40 defined by the first and second locations 32, 34 may be coupled to the base 22 and the stand 24. The stand adjustment assembly may be configured to adjust the angle θ of the line 40 within a range of 0.1 to 15.0 degrees.

The angular adjustment between the base 22 and the stand 24 may be performed either manually or automatically. For example, the stand adjustment assembly may include a drive mechanism formed by a chain that runs in a track. The drive mechanism may be controlled electronically, for example. Those skilled in the art are familiar with a variety of suitable drive mechanisms that would be appropriate for adjusting the angle θ between the base 22 and the stand 24. Therefore, the details of such mechanisms will not be described in detail herein.

Figure 11:
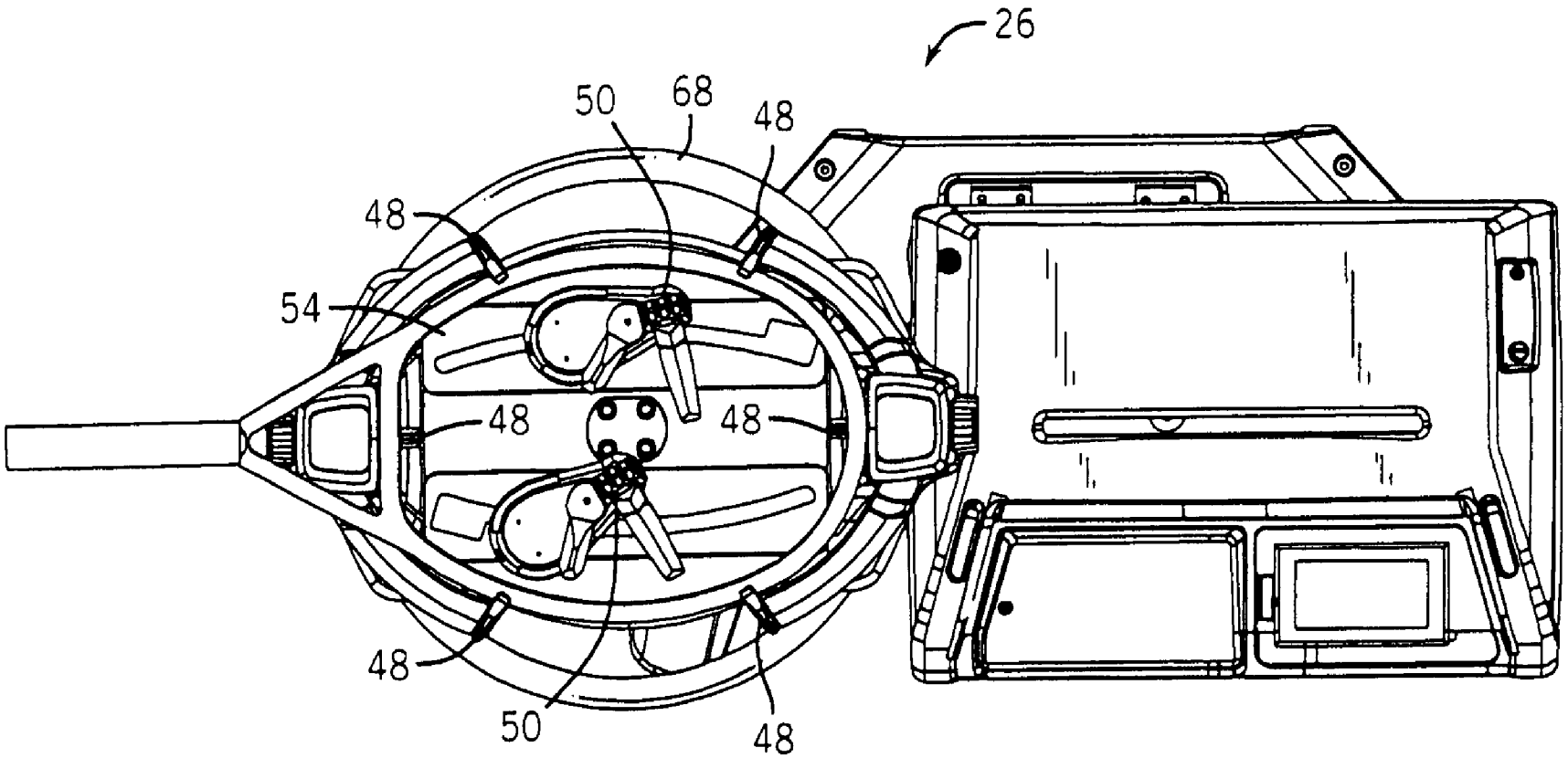
FIG. 11 is a top view of a stringing platform on a racquet stringing machine.
Figure 12:
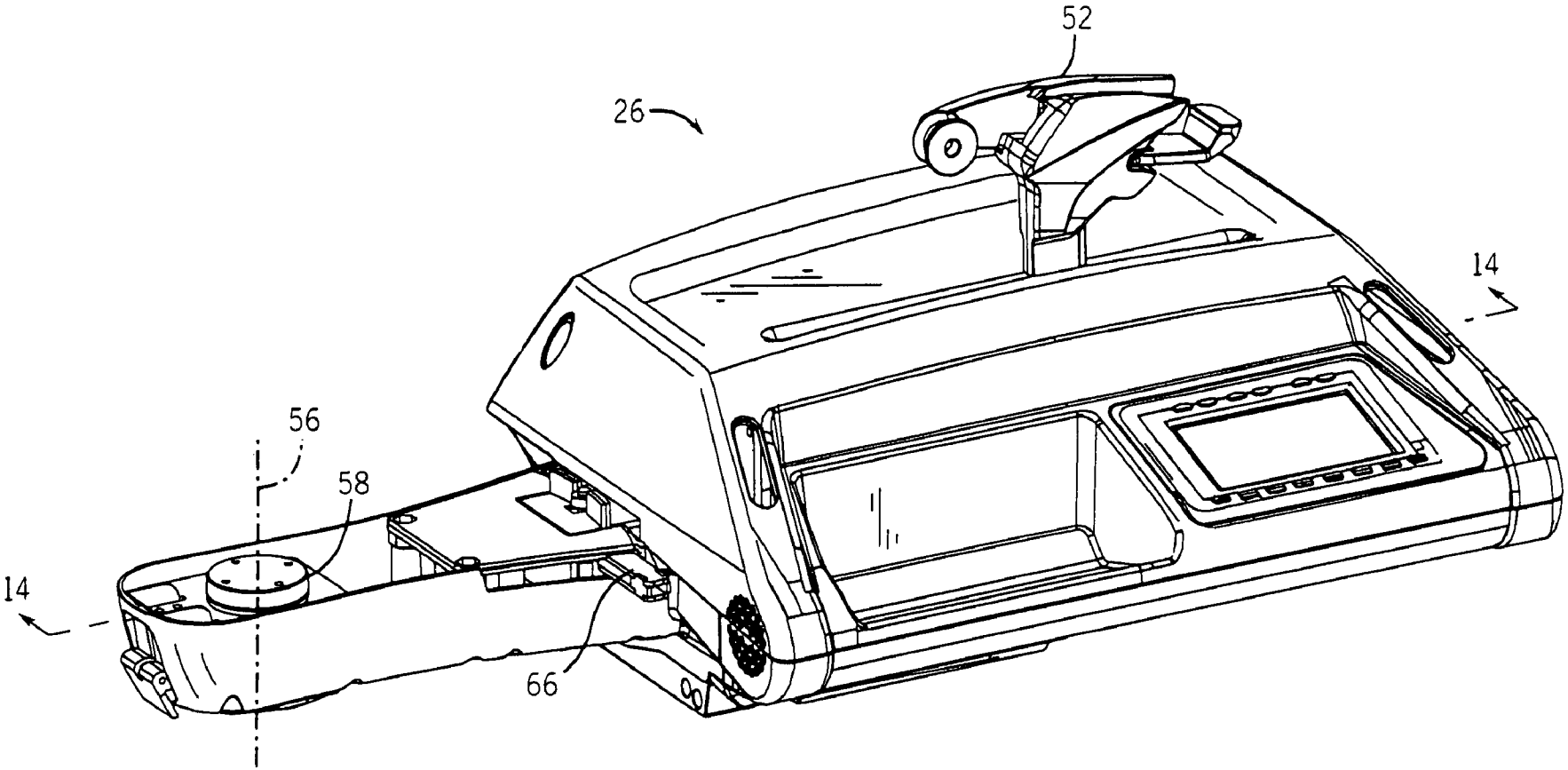
FIG. 12 is a perspective view of a stringing platform.

As illustrated in FIG. 11, the stringing platform 26 includes multiple frame clamps 48 for maintaining the frame of a racquet in place on the stringing platform 26, and two string clamps 50 for maintaining the strings in place during the stringing process. As shown in FIG. 12, a string tensioning assembly 52 is coupled to the stand 24 atop the stringing platform 26. The string tensioning assembly 52 pulls the strings to the desired tension during the stringing process. The stringing platform 26 may either be configured as shown in FIGS. 11 and 12 or, alternatively, may be a conventional stringing platform as found on conventional stringing machines.

Figure 13:
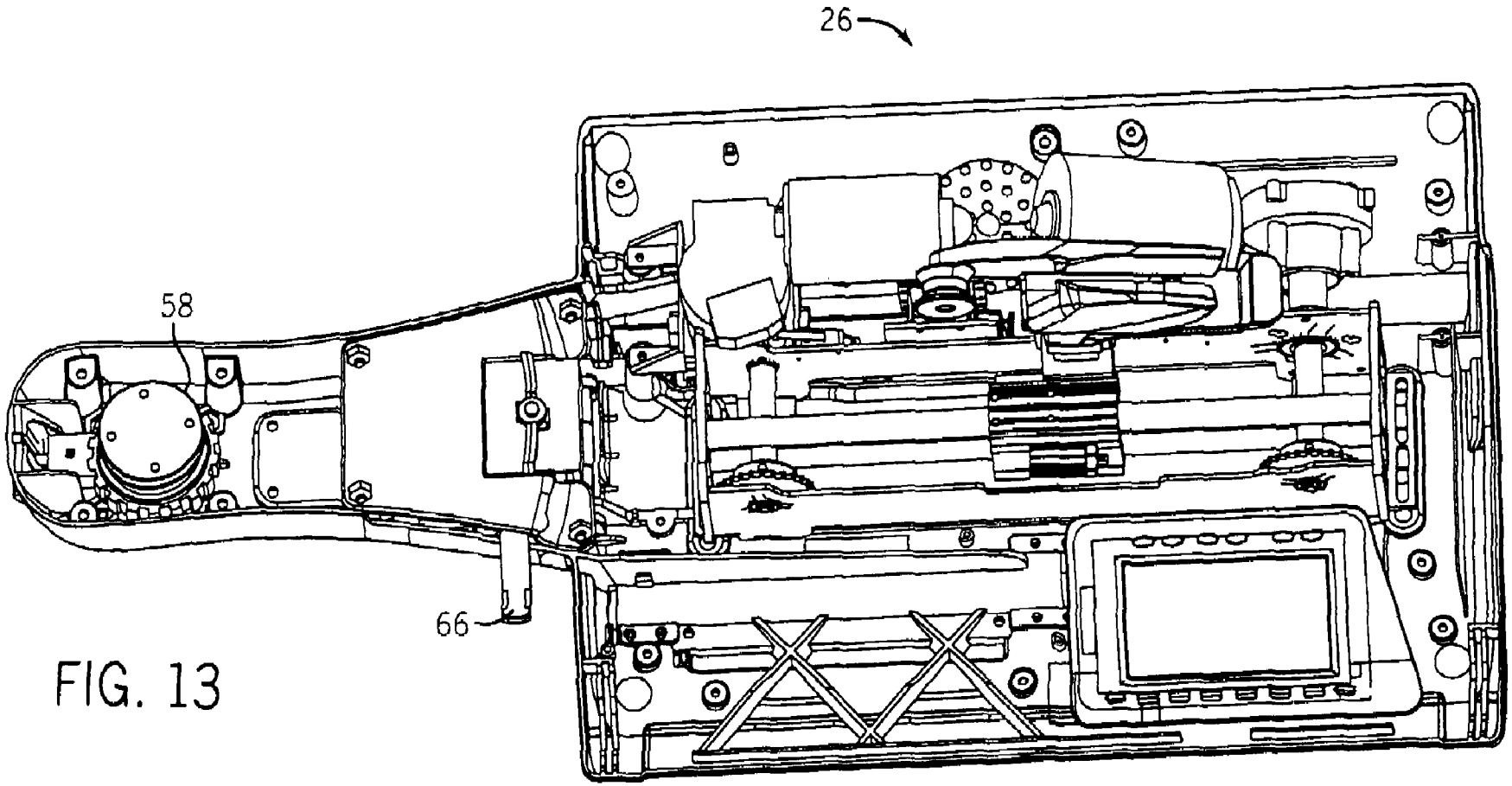
FIG. 13 is an interior view of a stringing platform.

In certain embodiments, the stringing platform 26 may include a turntable 54 rotatable about a first axis 56, and a first releasable resistance assembly 58, such as a grease brake, coupled to the turntable 54, as shown in FIGS. 11-13. The turntable 54 allows the racquet to spin in a plane in which the frame of the racquet lies. The first releasable resistance assembly 58 may be positionable between an engaged operating position in which the resistance assembly 58 resists rotation of the turntable 54 about the first axis 56, and a disengaged operating position in which the resistance assembly 58 does not resist rotation of the turntable 54 about the first axis 56.

The first releasable resistance assembly 58 can provide resistance to unintentional rotation of the turntable 54. In particular, the first releasable resistance assembly 58 can negate the effects of gravity when a racquet is in place and the stringing platform 26 is tilted, such as may be caused by the tilted angle of the stand 24. For example, the first releasable resistance assembly may provide a resistance against rotation of the turntable (resistance against a torque) about the first axis of within the range of 0.1 to 36 in-lbf, or more preferably within the range of 0.1 to 12.0 in-lbf.

The first releasable resistance assembly 58 suitably includes a high viscosity fluid, such as a grease, for resisting rotation of the turntable 54 when in the engaged operating position. The high viscosity fluid may have a viscosity range of 1 to 500 cP, for example. By using such a highly viscous lubricant, the turntable 54 can be maintained in place, even when the turntable 54 is lying in a plane non-parallel to the horizontal surface on which the stringing machine 20 is standing, without the need to mechanically lock the turntable 54 in place.

Figure 14:
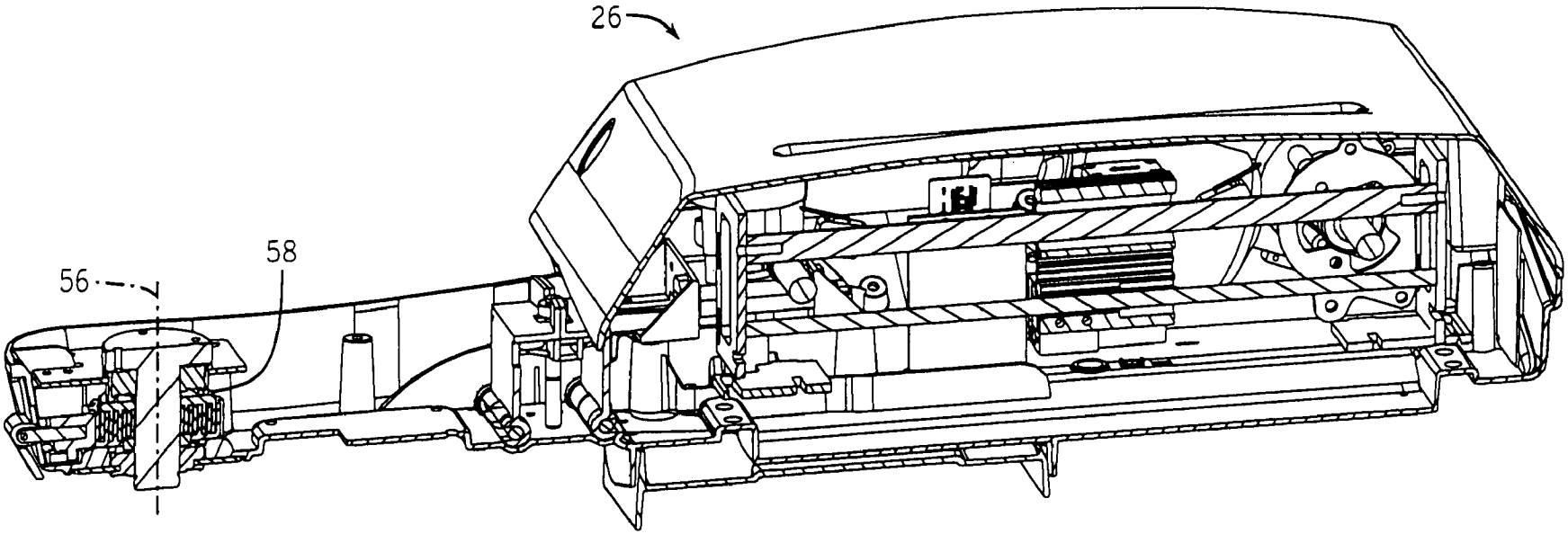
FIG. 14 is a cross-sectional view of the stringing platform of FIG. 12, taken along line 14-14.
Figure 15:
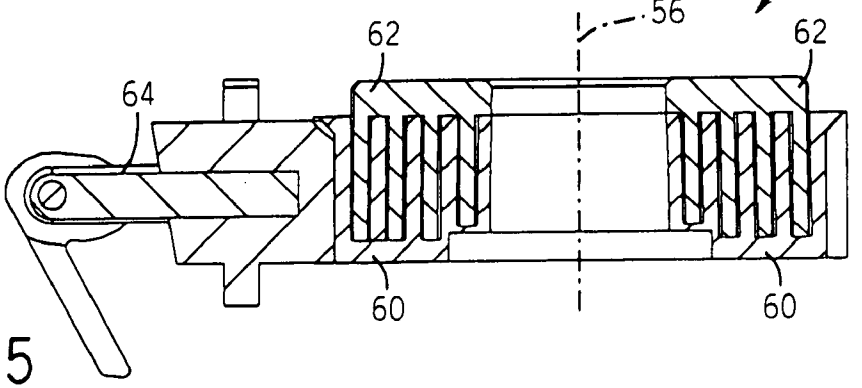
FIG. 15 is a cross-sectional view of a releasable resistance assembly.

In certain embodiments, the first releasable resistance assembly 58 includes first and second members 60, 62 contacting the high viscosity fluid, with at least one of the first and second members 60, 62 being rotatable about the first axis 56. FIG. 14 is a cross-sectional view of the stringing platform 26, which illustrates the first and second members 60, 62 in the first releasable resistance assembly 58. A cross-sectional view of the first releasable resistance assembly 58 is shown in greater detail in FIG. 15. The first and/or second members 60, 62 may include a plurality of projections, such as spaced-apart concentric rings, contacting the fluid. For example, each of the first and second members 60, 62 may include a plurality of spaced-apart concentric rings with the rings of the first and second members 60, 62 configured to correspond to each other such that portions of the rings of one of the members fit within the spaces between the rings of the other member. In alternative preferred embodiments, the first and second members 60 and 62 can take be formed in other corresponding shapes having different numbers of projections in different orientations.

The first releasable resistance assembly 58 may also include a latch 64 that releasably engages the first member 60 to prevent the first member 60 from rotating about the first axis 56. The latch 64 may be manually operated or remotely operated through a conventional actuation mechanism. In one preferred embodiment, the latch 64 can be used to switch the first resistance assembly 58 between the engaged operating position in which the resistance assembly 58 resists rotation of the turntable 54 about the first axis 56, and a disengaged operating position in which the resistance assembly 58 does not resist rotation of the turntable 54 about the first axis 56. When the latch 64 is positioned to engage the first member 60 and to prevent the member 60 from rotating about the first axis 56, the second member 62 remains free to rotate about the first axis 56. However, with the first member 60 in a locked position, the second member 62 rotates with respect to the first member 60 and the high viscosity fluid positioned between the corresponding projections of the first and second members 60 and 62 provides resistance to rotation of the second member 62 about the first axis 56.

As illustrated in FIG. 13, a second releasable resistance assembly 66, separate from the first releasable resistance assembly 58, may also be coupled to the stringing platform 26. For example, as shown in FIG. 11, the turntable 54 may include a ring 68 centered about the first axis 56, and the second releasable resistance assembly 66 may be configured to releasably engage the ring 68 to prevent rotation of the turntable 54 about the first axis 56. The mechanism of the second releasable resistance assembly 66 may be similar to a bicycle brake, with a lever operated by the user at one end and the opposite end designed to contact the inner surface of the ring 68 when the brake is applied, thus creating sufficient friction to prevent the turntable 54 from rotating. Preferably, the second releasable resistance assembly 66 releasably locks into position by the user. In contrast with the first releasable resistance assembly 58, which merely resists rotation, the second releasable resistance assembly 66 is configured to directly stop the turntable 54 from rotating about the first axis 56, including bringing the turntable 54 to a stop in mid-rotation.

Any one or more of the stringing machine embodiments described herein may be applied to machines for stringing tennis racquets, racquetball racquets, squash racquets, badminton racquets, and any other strung racquet. In particular, the stringing machine 20 may be used to string racquets for use in an organized professional league and/or in competitive play. Furthermore, the stringing machine 20 may be configured to string racquets in a manner that meets ITF Rules of Tennis requirements for racquet strings. Regardless of the type of racquet, compatibility of the stringing machine 20 with the user is greatly improved by using any of the stringing machine enhancements in this invention.

While the preferred embodiments of the invention have been illustrated and described, it will be appreciated that various changes can be made therein without departing from the spirit and scope of the invention. For example, while the embodiments described herein are illustrated in a stringing machine for stringing a tennis racquet, the principles of the present invention could also be used for stringing machines for stringing practically any other type of racquet. Accordingly, it will be intended to include all such alternatives, modifications and variations set forth within the spirit and scope of the appended claims.

What is claimed is:

1. A racquet stringing machine for stringing of a racquet by a user positioned in an operating position, the stringing machine comprising:

a base configured for supporting the stringing machine on a generally horizontal surface;

a stand having upper and lower end regions, the lower end region of the stand upwardly extending from a first location of the base;

an adjustable stringing platform coupled at a second location to the upper end region of the stand, the first and second locations defining a line that is angled by a predetermined angle from horizontal such that the line extends from the first location generally toward the operating position of the user, the predetermined angle being greater than or equal to 70 degrees and less than or equal to 89 degrees from horizontal; and a string tensioning assembly coupled to the stand.

2. The stringing machine of claim 1, wherein the predetermined angle is greater than or equal to 80 degrees and less than or equal to 85 degrees from horizontal.

3. The stringing machine of claim 1, wherein the predetermined angle is approximately 83 degrees from horizontal.

4. The stringing machine of claim 1, wherein the base has a forward side intended to face the user and a rear side, and wherein the forward side of the base defines a recessed area for accommodating at least a portion of the user's feet thereby enabling the user to stand closer to the racquet during stringing.

5. The stringing machine of claim 1, further comprising a stand adjustment assembly coupled to the base and the stand, wherein the stand adjustment assembly is configured to adjust the angle of the line defined by the first and second locations with horizontal.

6. The stringing machine of claim 5, wherein the stand adjustment assembly is configured to adjust the angle of the line with respect to horizontal within a range of 0.1 to 15.0 degrees.

7. The stringing machine of claim 1, wherein the adjustable stringing platform includes a turntable rotatable about a first axis.

8. The stringing machine of claim 7, wherein the adjustable stringing platform further includes a first releasable resistance assembly coupled to the turntable, and wherein the first releasable resistance assembly is positionable between an engaged operating position in which the releasable resistance assembly resists rotation of the turntable about the first axis, and a disengaged operating position in which the releasable resistance assembly does not resist rotation of the turntable about the first axis.

9. The stringing machine of claim 8, wherein the releasable resistance assembly includes a high viscosity fluid for resisting rotation of the turntable when in the engaged operating position.

10. A stringing machine, comprising:

a base;

a stand coupled to and upwardly extending from the base;

an adjustable stringing platform coupled to the stand, the stringing platform including a turntable rotatable about a first axis, and a first releasable resistance assembly coupled to the turntable, the first releasable resistance assembly being positionable between an engaged operating position in which the releasable resistance assembly resists rotation of the turntable about the first axis, and a disengaged operating position in which the releasable resistance assembly does not resist rotation of the turntable about the first axis, the releasable resistance assembly including a high viscosity fluid for resisting rotation of the turntable about the first axis when in the engaged operating position.

11. The stringing machine of claim 10, further comprising a second releasable resistance assembly coupled to the stringing platform, and wherein the second releasable resistance assembly is separate from the first releasable resistance assembly.

12. The stringing machine of claim 11, wherein the turntable includes a ring centered about the first axis, and wherein the second releasable resistance assembly is configured to releasably engage the ring to prevent rotation of the turntable about the first axis.

13. The stringing machine of claim 10, wherein the first releasable resistance assembly resists a torque about the first axis within the range of 0.1 to 36 in-lbf.

14. The stringing machine of claim 10, wherein the first releasable resistance assembly resists a torque about the first axis within the range of 0.1 to 12 in-lbf.

15. The stringing machine of claim 13, wherein the resistance force applied by the first releasable resistance assembly is 3 lbs or less.

16. The stringing machine of claim 10, wherein the first releasable resistance assembly includes first and second members contacting the high viscosity fluid, and wherein at least one of the first and second members is rotatable about the first axis.

17. The stringing machine of claim 16, wherein the first releasable resistance assembly further comprises a latch, and wherein the latch releasably engages the first member to prevent the first member from rotating about the first axis.

18. The stringing machine of claim 16, wherein at least one of the first and second members includes a plurality of projections contacting the fluid.

19. The stringing machine of claim 18, wherein the projections are a plurality of spaced apart concentric rings.

20. The stringing machine of claim 18, wherein each of the first and second members includes a plurality of spaced apart concentric rings, and wherein the rings of the first and second portions are configured to correspond to each other such that portions of the rings of one of the members fit within the spaces between the rings of the other member.

21. The stringing machine of claim 10, wherein the high viscosity fluid is a grease.

22. The stringing machine of claim 10, wherein the high viscosity fluid has a viscosity range of 1 to 500 cP.

* * * * *